United States Patent [19]

Feliks

[11] Patent Number: 4,827,382

[45] Date of Patent: May 2, 1989

[54] TURBINE LAMP SHADE ASSEMBLY

[76] Inventor: Robert C. Feliks, 815 S. Lafayette, Dearborn, Mich. 48124

[21] Appl. No.: 202,236

[22] Filed: Jun. 3, 1988

[51] Int. Cl.[4] ..... F21V 21/30

[52] U.S. Cl. ..... 362/35; 362/96; 362/294; 362/806; 40/441; 446/210

[58] Field of Search ..... 362/96, 294, 354, 360, 362/361, 806, 35, 373; 40/441; 446/210

[56] References Cited

U.S. PATENT DOCUMENTS

| | | | |
|---|---|---|---|
| 1,728,166 | 9/1929 | Horton | 40/441 |
| 2,840,689 | 6/1958 | Kazor | 40/441 X |
| 3,686,494 | 8/1972 | Naylor | 40/441 |

*Primary Examiner*—Stephen F. Husar

*Attorney, Agent, or Firm*—Peter D. Keefe

[57] ABSTRACT

A multiple lamp shade system for a light bulb in which one of the lamp shades is rotatable and powered by heat given off by the light bulb. A multiply apertured base is held against a light bulb socket by surface contact with the light bulb. A light transmissible stationary inner lamp shade is attached at one end to the base. The other end of the inner lamp shade is partially occluded by a thrust plate on which is located an axially positioned upstanding pointed member. A peripheral annular gap is provided between the wall of the inner lamp shade and the thrust plate. A light transmissible rotatable lamp shade is co-axially mounted over the inner lamp shade and is bearingly supported via a bearing plate, at one end on the upstanding pointed member. A plurality of air vent chutes are annularly arranged adjacent the bearing plate. In operation, the light bulb heats the air within the lamp shades, causing an air convection current which upwells within the lamp shades. The air convection current inside the inner lamp shade is throttled through the annular gap, causing its flow rate to speed up considerably. The air convection current then enters the air vent chutes and exits therefrom in a substantially horizontal direction to cause the outer lamp shade to rotate as a reaction thereto.

20 Claims, 2 Drawing Sheets

TURBINE LAMP SHADE ASSEMBLY

BACKGROUND OF THE INVENTION

1. Field of the Invention

The present invention is related to rotatably mounted lamp shades, and particularly to rotatably mounted lamp shades which are structured to be caused to rotate as a result of air convection currents generated by the heat produced by a light bulb that is at least partially covered by the lamp shade.

2. Description of the Prior Art

It is a well known in the art to place a translucent shade over electric light bulbs in order to reduce glare and present a generally pleasing effect to the eye. In this regard, lamp shades have over the years acquired a profusion of various types and shapes which fit essentially every imaginable situation.

One of these situations is that of rotatably mounting the lamp shade in order to create a variating scene or other creative visual effect when the light bulb for which it is mounted is illuminated. Generally, it is acknowledged in the art that to cause a lamp shade to rotate in a most efficient and effective manner, it must be mounted to a stationary lamp structure with a minimum of bearing resistance and, importantly, be capable of being rotated by air convection currents generated by the heat of the adjacent illuminated electric light bulb.

A number of proposals have been presented in the prior art which attempt to achieve adequate rotation speed coupled with reasonable size and weight restrictions. Generally, these proposals fall into two broad categories: singular lamp shades systems and multiple lamp shade systems.

Single lamp shade systems generally consist of a lamp with a rotatably mounted lamp shade. An example of such a system is represented by U.S. Pat. No. 290,489 dated Dec. 18, 1883 to Simpson which discloses a display body encompassing a source of illumination that is heating the air within the display body. The display body has a series of vanes at its uppermost end through which rising heated air circulates. As a result of force applied by the moving air on the vanes, the display body is caused to rotate on a shaft. Examples of similar devices are disclosed in U.S. Pat. Nos. 352,646 dated Nov. 16, 1886 to Gennert; 1,972,687 dated Sept. 4, 1934 to McCoy; and 3,435,201 dated Mar. 25, 1969 to Kemenczky. These devices all suffer from the problem of excessive weight and ineffective production of and control over the air convection currents resulting in sporadic, erratic and slow rotation rates of the lamp shade.

Multiple lamp shade systems generally have a lamp to which is attached both a stationary lamp shade and a coaxially mounted rotatable lamp shade, the interplay between the lamp shades causing a desired visual effect. An example of such a system is represented by U.S. Pat. No. 1,066,493 dated July 8, 1913 to Harrold which discloses a lamp surrounded by a stationary cylindrically shaped exterior lamp shade having a rectangularly shaped aperture on its cylindrical side wall. A cylindrically shaped rotatable lamp shade is coaxially mounted with respect to the stationary lamp shade by a mounting member of the lamp. At the upper end of the cylindrical wall of the rotatable lamp shade is located a series of vanes. Figures are attached to the rotatable lamp shade. When the lamp bulb is illuminated, heat from the bulb causes air to rise through the vanes, making the rotatable lamp shade rotate. Rotation of the rotatable lamp shade causes the figures to periodically pass the rectangular aperture yielding a desired visual effect. Examples of other multiple lamp shade systems are disclosed in U.S. Pat. Nos. 1,178,764 dated Apr. 11, 1916 to Watanabe; 1,865,758 dated July 5, 1932 to Horton; 2,398,974 dated Apr. 23, 1946 to Storm; and dated Sept. 16, 1952. These devices also suffer from the aforementioned problems plaguing single lamp shade systems, namely excessive weight and inability to produce and control air convection currents so that rotary motion of the rotatable lamp shade is sporadic, erratic and slow.

The aforementioned problems could be solved, as exemplified by the patent to Watanabe, by utilizing large and very hot light bulbs within the rotatable lamp shade so as to induce a substantial flow of convecting air through the vanes. However, this has the disadvantage of considerable size, excessive power consumption, and restricted applicability to large lighting environments.

Accordingly, what is needed in the art is a rotatable lamp shade system which derives its rotary movement from convecting air caused by heating of a light bulb including a bulb of small size, wherein the rotatable lamp shade will dependably rotate with a consistent and regular rate of rotation and the rotatable lamp shade has minimal weight because the heat produced by the light bulb is strictly controlled to efficiently heat the adjacent air and the resulting air convention currents are strategically directed to have maximum effect at the vanes.

SUMMARY OF THE INVENTION

The present invention is a multiple lamp shade system in which an outer lamp shade is rotatable and an inner lamp shade is stationary.

According to the present invention, a socket is provided for screw mounting an electric light bulb in a conventional manner. A multiply apertured base is located between the socket and the light bulb and is held in relation to the socket by tension of the light bulb as a result of it being screwed into the socket. The stationary lamp shade is of cylindrical shape and snap fits into the periphery of the base. The upper end of the inner lamp shade has a centrally located conical member which points into the lamp shade and is supported by ribs. The ribs allow for an annular gap between the inner lamp shade cylindrical surface and the periphery of the conical member. An upstanding pointed projection member is located at the center of the frustoconical member and faces in a direction away from the interior of the inner lamp shade. The outer lamp shade is of a frustoconical shape in which a larger diameter is provided at the lower end as compared with the diameter at the upper end thereof. The lower end is open and is substantially larger in diameter than the diameter of the inner lamp shade. The upper end, which also has a diameter that is larger than the diameter of the inner lamp shade, terminates in a cap. The cap has a series of turbine blades located annularly adjacent the connection of the cap to the frustoconical wall of the outer lamp shade. The center of the cap is conically dimpled, with the apex of the cone facing away from the interior of the outer lamp shade.

The inner lamp shade is secured to the base, which in turn is secured to the socket and its associated lamp fixturing. The outer lamp shade is rotatably supported on the inner lamp shade, in which the upstanding pointed projection member fits into the apex of the conical dimple.

In operation heat produced by the light bulb is concentrated by the small space provided within the inner lamp shade. This causes a significant heating in the aforesaid space with an attendant expansion of air therein resulting in an upwardly mobile air convection current. The air convection current is diverted by the conical member to pass through the gap at its periphery. In accordance with Bernoulli's Principle, air stream velocity is caused to increase as the cross section of the air convection current is throttled. This enhanced air stream velocity is now immediately directed into the annularly arranged turbine blades, resulting in a dependably consistent and significant rate of rotation of the outer lamp shade.

Accordingly, it is an object of the present invention to provide a multiple lamp shade system which has a rotatable member in which its rotation is secured by a highly efficient use of the heat generated by the source of illumination therein.

It is a further object of the present invention to provide a multiple lamp shade system which has a rotatable member in which its rotation is enhanced by a throttling process performed on the induced air convection current just in advance of passage through turbine blades or vanes on the rotatable member.

It is yet a further object of the present invention to provide a multiple lamp shade system which has a rotatable member in which its rotation is maximized by utilization of strategically located turbine blades or vanes having a shape which produces a maximum of rotational thrust when upwelling air passes therethrough.

It is another object of the present invention to provide a multiple lamp shade system which has a rotatable member in which its rotation is aided by a minimum of structural weight and a highly efficient bearing system for mounting thereof.

It is still another object of the present invention to provide a multiple lamp shade system which has a rotatable member in which the multiple lamp shade system is removably secured to the socket when the light bulb is screwed into the socket.

It is yet another object of the present invention to provide a multiple lamp shade system which has a rotatable member and a stationary member in which patterns of predetermined nature are present on the surfaces of the rotatable and stationary members, the rotation of the rotatable member in combination with the stationary member resulting in a predetermined visual display pattern.

These and additional objects, features, advantages, and benefits of the present invention will become apparent from the following description of the preferred embodiment.

DETAILED DESCRIPTION OF THE PREFERRED EMBODIMENT

Figure 1:
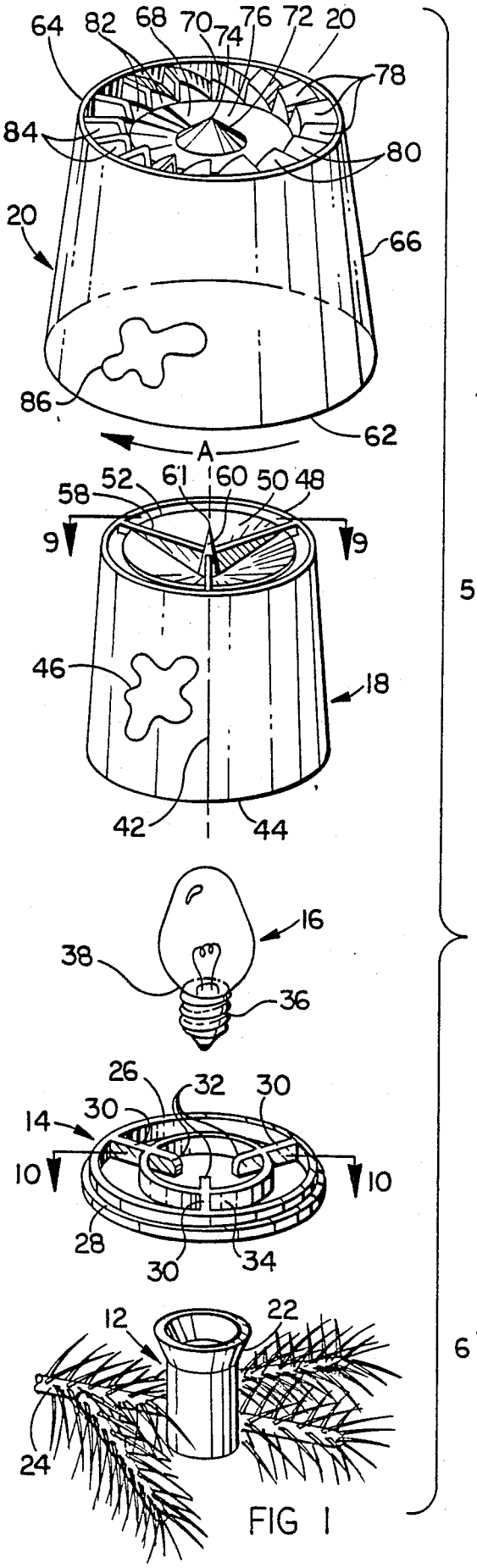
FIG. 1 is an exploded perspective side view of the multiple shade system according to the present invention, shown in an environment of use.
Figure 4:
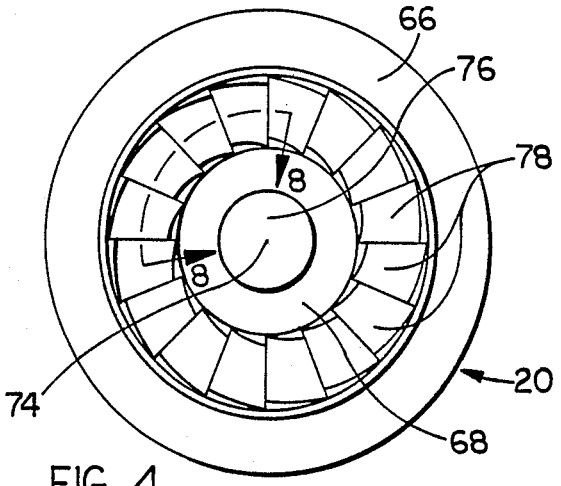
FIG. 4 is a plan view of the multiple shade system along line 4—4 of FIG. 3.
Figure 3:
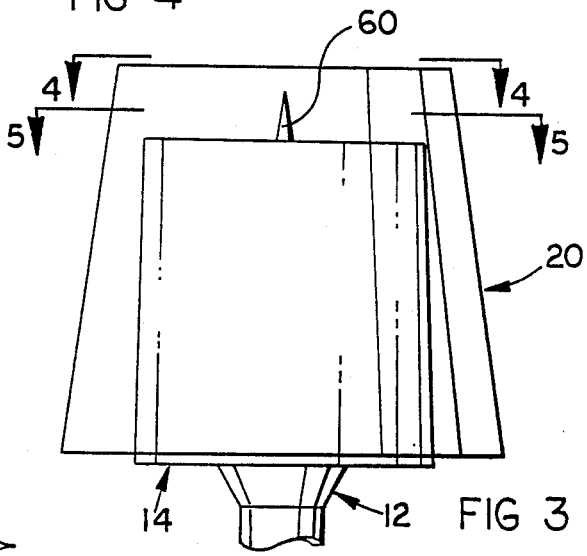
FIG. 3 is a side view of the multiple shade system of FIG. 2.
Figure 2:
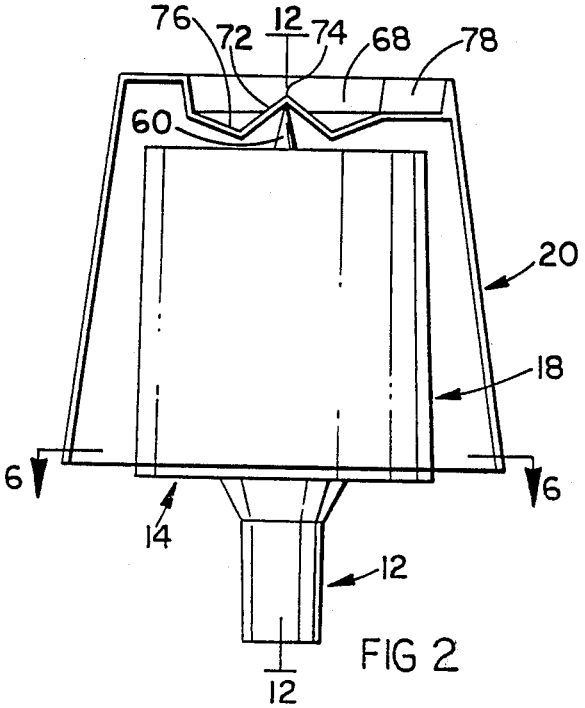
FIG. 2 is a part sectional side view of the multiple shade system according to the present invention.
Figure 5:
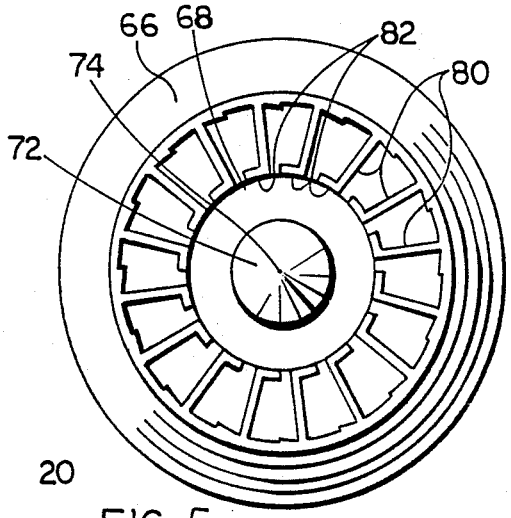
FIG. 5 is a sectional plan view of the outer lamp shade along line 5—5 in FIG. 3.
Figure 6:
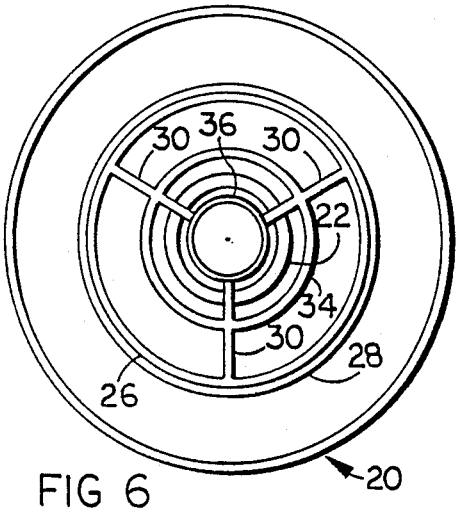
FIG. 6 is a sectional view of the multiple shade system according to the present invention along line 6—6 in FIG. 2.
Figure 7:
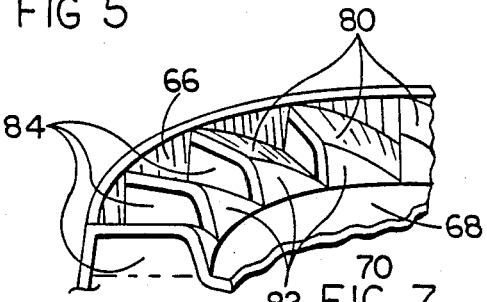
FIG. 7 is a detailed part sectional perspective view of the air vent chutes and bearing plate of the outer lamp shade according to the present invention.
Figure 8:
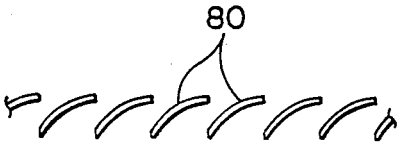
FIG. 8 is a sectional view of the curved members of the air vent chutes according to the present invention, seen along line 8—8 in FIG. 4.
Figure 9:
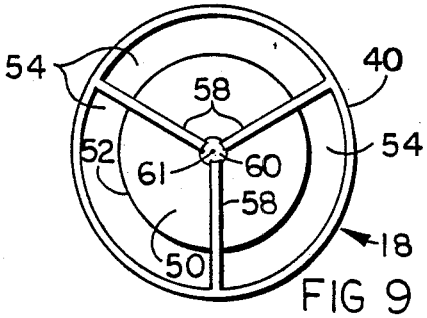
FIG. 9 is a plan view of the inner lamp shade along line 9—9 in FIG. 1.
Figure 10:
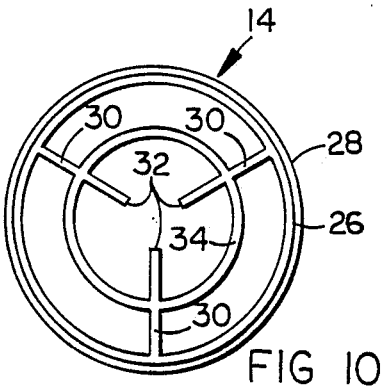
FIG. 10 is a plan view of the multiply apertured base along line 10—10 in FIG. 1.

Referring now to the drawing, FIG. 1 shows an exploded view of the multiple shade system 10 according to the present invention in operation. It will be seen from the Figure that there are 5 essential parts to the invention: a socket member 12, a multiply apertured base 14, a light bulb 16 which screws into the socket and secures the base to the socket, a stationary inner lamp shade 18 which attaches to the base, and an outer rotatable lamp shade 20 which is bearingly supported on the inner lamp shade.

The socket 12 is of a substantially conventional type, in that it is electrically connectable, via electrical wires constituting a conventional circuit, to a source of electricity, such as a 115 volt wall outlet; more than one such socket 12 may be on the circuit. The socket 12 is provided with a flared annular rim 22 connected with the socket at the end into which the light bulb 16 is screwed. In the environmental exposition indicated by FIG. 1, the invention is being used in a Christmas display ornament, and the socket is conveniently and conventionally attached to a branch 24 of a Christmas tree.

As can be seen from FIGS. 1, 6, 10 and 11, the apertured base 14 is of a flat, cylindrical configuration, having an outer annular ring 26 which includes an annular shoulder 28. A plurality of ribs 30 radially extend inwardly from the outer annular ring 26 and terminate at ends 32 so that the light bulb 16 may be inserted therebetween and be in surface engagement therewith when the invention 10 is assembled in the manner herein described. It is preferred that the ends 32 of the ribs 30 include rounded corners in order to facilitate the aforesaid surface engagement with the light bulb, as particularly shown in FIG. 11. It is further preferred to include an intermediate ring 34 located between the terminal ends of the ribs 30 and the outer annular ring 26 so as to add strength to the base.

Figure 11:
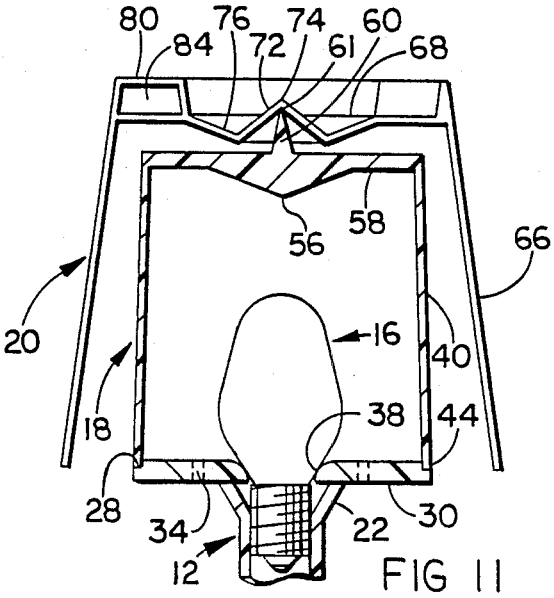
FIG. 11 is a part sectional view of the multiple shade system according to the present invention.
Figure 12:
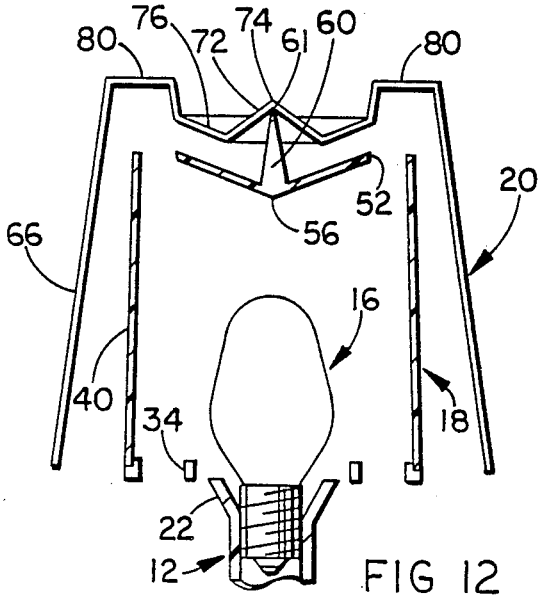
FIG. 12 is a part sectional side view as in FIG. 11, seen at line 12—12 in FIG. 2.

As can be seen from FIGS. 1, 11 and 12, the light bulb 16 is of a conventional type. Because of the structure of the present invention 10, it is not necessary that the light bulb be of an unusually high heat generating capacity; that is, the light bulb 16 may be selected primarily for its illuminative capacity provided it generates a customary level of heat attendant to its operation. The light bulb 16 has a conventional threaded male fitting 36 for being screwed into a complementary female fitting in the socket. The glass of the light bulb is also conventional and its portion 38 closest to the male fitting 36 is intended to abut the rounded corner at the ends 32 of the ribs 30 when the invention 10 is assembled as herein described and shown in FIG. 11.

As can be seen from FIGS. 1, 2, 9, 11 and 12, the stationary inner lamp shade 18 is preferred to be of generally cylindrical shape, having a thin inner lamp shade wall 40 and an axial center line 42; it is possible, if desired, to give the stationary inner lamp shade a slight taper so that it is widest at its lower end 44. The lower end 44 of the thin inner lamp shade wall 40 of the stationary inner lamp shade 18 is open. The thin inner lamp shade wall 40 is constructed of a translucent or clear light transmitting material, such as mylar or plastic. Scenes, designs or other illustrations 46 may be applied to the surface thereof. The upper end 48 of the inner lamp shade wall 40 is open, but partially occluded by a thrust plate 50. The thrust plate 50 has a circularly shaped periphery 52, having an outside diameter which is less than the inside diameter of the inner lamp shade wall at the upper end 48, resulting in an annular gap 54 between the periphery 52 and the inner lamp shade wall 40. The thrust plate 50 has the cross section of a cone whose apex 56, as seen best in FIGS. 11 and 12, is directed toward the lower end 44 of the inner lamp shade wall 40. The thrust plate is connected to the upper end 48 of the inner lamp shade wall, across the gap 54, by a plurality of support members 58, three of which being utilized in the preferred embodiment. An upstanding pointed member 60, having a point 61, is attached to the thrust plate opposite the apex 56 and oriented along the axial center line 42. As can be seen from FIG. 1, it is preferred that the support members terminate in abutment with the upstanding pointed member in order to provide rigid support thereto.

As can be seen from FIGS. 1 through 8, 11 and 12, the rotatable outer lamp shade 20 is preferred to have a frustoconical shape in which the lower end 62 has a diameter exceeding that of the upper end 64. The diameter of the upper end 64 exceeds the diameter of the stationary inner lamp shade 18 so that the rotatable outer lamp shade may be placed over the stationary inner lamp shade and there will be no surface to surface contact other than at the hereinbelow described bearing location 61. It is preferred that the rotatable outer lamp shade 20 be constructed of a thin outer lamp shade wall 66 which is translucent or clear so that light may be transmissible therethrough. A suitable material therefor is mylar or plastic. The lower end 62 of the outer lamp shade wall 66 is open. The upper end 64 of the outer lamp shade wall 66 is partially occluded by a bearing plate 68. The bearing plate has a circular periphery 70 and has at its center a bearing cone 72, the apex 74 of which is directed away from the lower end 62. In the preferred embodiment, as best shown in FIGS. 1, 11 and 12, the bearing plate 68 includes a frustoconically shaped portion 76 adjacent the bearing cone 72, the purpose of which will become evident from the operational description hereinbelow. Between the bearing plate and the upper end 64 of the outer lamp shade wall 66 is a plurality of air vent chutes 78 that are arranged annularly about the bearing plate 68. Each air vent chute is preferred to have a U-shape, composed of a curved member 80 and a side member 82; in the preferred embodiment the outer lamp shade wall forms a part of the U-shape. Each air vent chute 78 has an opening 84, each successively facing in the direction of the preceding air vent chute, as shown best in FIGS. 1, 4 and 7. It is preferred that the entire rotatable outer lamp shade 20 including the bearing plate and the air vent chutes be injection molded of plastic in a single piece. Other modes of making area possible; for example, the bearing plate and the air vent chutes can be die cut and stamped out of a single piece of metal. The outer lamp shade wall 66 may have a plurality of drawings, symbols or illustrations 86 which are intended to interact with those illustrations 46 on the inner lamp shade so as to create a pleasing effect when the multiple lamp shade system 10 according to the present invention is assembled and operating.

Operation and assembly of the multiple lamp shade system 10 will now be described.

As can be most readily discerned by reference to FIGS. 1 and 11, the male fitting 36 light bulb 16 is inserted into the multiply apertured base 14 adjacent the ends 32 of the ribs 30. The light bulb is then screwed into the socket 12. It will be appreciated that the base 14 is held securely by the interaction of the glass 38 of the light bulb and the flared annular rim 22 of the socket.

The stationary inner lamp shade 18 is placed onto the multiply apertured base 14 by locating the lower end 44 of the inner lamp shade wall 40 on the annular shoulder 28 of the base. A snap or friction fit between the aforesaid parts causes the stationary inner lamp shade 18 to be secured to the base 14.

The rotatable outer lamp shade 20 is then placed over the stationary inner lamp shade 18 so that the stationary inner lamp shade 18 is received inside the rotatable outer lamp shade 20. The apex 74 of the bearing cone is then positioned onto the point 61 of the pointed member 60. In this manner a very low friction bearing location is established, and no other contact is made between the inner and outer lamp shades. Importantly in this regard, the bearing cone is structured to cooperate with the pointed member so as to automatically center the point 61 thereof into the apex of the bearing cone. Assembly is now complete.

Operation begins when the light bulb 16 is illuminated. The heat produced by the filament of the light bulb causes the air contained within the stationary inner lamp shade 18 to heat. At the same time infrared radiant energy interacts with the inner and outer lamp shades and causes them to heat as well, with a substantial bulk of the aforesaid heating occurring on the inner lamp shade. Consequently, there is added heating of the air within the stationary inner lamp shade 18 and some heating of air between the inner lamp shade and the rotatable outer lamp shade 20. The heated air tends to naturally expand, giving it a lesser density than the colder, ambient air of the surrounding local atmosphere. Because this air has lesser density, it will tend to convect upwardly, under the well known principles of buoyancy. Aerodynamically aided by the conical shape of the thrust plate 52, the upwelling air across the diameter of the stationary inner lamp shade 18 is forced to flow through the much smaller cross section afforded by the gap 54. It is a well know fluidic law, Bernoulli's Principle, that when flowing fluid encounters a constriction it speeds up. Accordingly, the rate of upward movement of the heated air substantially increases as it passes through the gap 54. This air now meets upwelling heated air located between the inner and outer lamp shades. The combined air convection current now is directed by the frustoconically shaped portion 76 of the bearing plate 68 to exit to the local atmosphere through the air vent chutes 78. In this regard, the curved member 80 aerodynamically directs the air convection current out the opening 84. Since each of the openings are oriented so as to contribute to rotating the rotatable outer lamp shade 20 in a single direction, indicated by arrow A in FIG. 1, the outer lamp shade rotates in a reliable, predictable, steady and considerable angular velocity. As the outer lamp shade rotates, a pleasing visual effect may become apparent as the depictions 46 and 86 interact visually.

To those skilled in the art to which this invention appertains, it is clear that the invention herein described is subject to change and modification. Accordingly, this invention is not intended to be limited to the specifics of the hereinabove recited preferred embodiment, but is to be limited only by the scope of the appended claims.

What is claimed is:

1. A multiple lamp shade system for a light bulb, heat from said light bulb producing an air convection current, said multiple lamp shade system comprising:

a light bulb socket for receiving said light bulb;

an apertured base adjacent said socket;

a light transmissible stationary inner lamp shade having a first end and a second end, said first end of said stationary inner lamp shade being removably attached to said apertured base;

exit means mounted at said second end of said stationary inner lamp shade for causing said air convection current having a first speed of movement when within said stationary inner lamp shade to exit said stationary inner lamp shade at a substantially increased speed of movement over said first speed of movement;

a light transmissible rotatable outer lamp shade having a first end and a second end, said rotatable outer lamp shade removably and co-axially receiving said stationary inner lamp shade;

bearing means connected with said stationary inner lamp shade and said rotatable outer lamp shade for removably and rotatably supporting said rotatable outer lamp shade on said stationary inner lamp shade;

thrust means mounted at said second end of said rotatable outer lamp shade for directing said air convection current so that said rotatable outer lamp shade is caused to rotate on said bearing means.

2. The multiple lamp shade system of claim 1, wherein said exit means comprises:

a thrust plate having a circular periphery; and a plurality of ribs connecting said thrust plate with said second end of said stationary inner lamp shade so that an annular gap is present between said circular periphery of said thrust plate and said second end of said stationary inner lamp shade.

3. The multiple lamp shade system of claim 2, wherein said thrust plate further has a conically shaped portion, said conically shaped portion having an apex located equidistant from said periphery and facing toward said first end of said stationary inner lamp shade.

4. The multiple lamp shade system of claim 2, wherein said bearing means comprises:

an upstanding pointed member located on said thrust plate at a location equidistant from said periphery, said upstanding pointed member having a pointed end facing directly away from said first end of said stationary inner lamp shade; and a bearing plate located at said second end of said rotatable outer lamp shade, said bearing plate having centrally located bearing cone, said bearing cone having an apex facing away from said first end of said rotatable outer lamp shade, said bearing cone further being shaped so that said pointed end of said upstanding pointed member is caused to center in said apex of said bearing cone for bearingly supporting said rotatable outer lamp shade on said stationary inner lamp shade when said rotatable outer lamp shade receives said stationary inner lamp shade.

5. The multiple lamp shade system of claim 4, wherein said thrust means comprises:

air chute means annularly arranged between said bearing plate and said second end of said rotatable outer lamp shade for causing said air convection current to be directed in a substantially tangential direction with respect to said bearing means to thereby cause rotation of said rotatable outer lamp shade.

6. The multiple lamp shade system of claim 5, wherein said air chute means comprise:

a plurality of air vent chutes, each said air vent chute comprising:

a curved member for aerodynamically directing said air convection current to exit said air vent chute in said tangential direction; and side member means for confining said air convection current while said convention current is being aerodynamically directed to said tangential direction.

7. The multiple lamp shade system of claim 6, wherein said thrust means further comprises flow means for ensuring said convection current is aerodynamically directed into said thrust means.

8. The multiple lamp shade system of claim 7, wherein said flow means comprises a frustoconically shaped member on said bearing plate, said frustoconically shaped member being located between said bearing cone and said plurality of air chute means.

9. The multiple lamp shade system of claim 7, wherein said apertured base plate is secured adjacent said socket by surface engagement of said light bulb with said apertured base plate when said light bulb is screwed into said socket.

10. The multiple lamp shade system of claim 9, further comprising depictions on each of said stationary inner lamp shade and said rotatable outer lamp shade, said depictions visually interacting when said multiple lamp shade system is in operation.

11. The multiple lamp shade system of claim 10, further comprising an electrical circuit means connected with said socket for electrically connecting a source of electricity with said light bulb.

12. A multiple lamp shade system for a light bulb, heat from said light bulb producing an air convection current, said multiple lamp shade system comprising:

a light bulb socket for receiving said light bulb;

an apertured base adjacent said socket;

a light transmissible stationary inner lamp shade having a first end and a second end, said first end of said stationary inner lamp shade being removably attached to said apertured base;

exit means mounted at said second end of said stationary inner lamp shade for causing said air convection current having a first speed of movement when within said stationary inner lamp shade to exit said stationary inner lamp shade at a substantially increased speed of movement over said first speed of movement, said exit means comprising:

a thrust plate having a circular periphery; and a plurality of ribs connecting said thrust plate with said second end of said stationary inner lamp shade so that an annular gap is present between said circular periphery of said thrust plate and said second end of said stationary inner lamp shade;

a light transmissible rotatable outer lamp shade having a first end and a second end, said rotatable outer lamp shade removably and co-axially receiving said stationary inner lamp shade;

bearing means connected with said stationary inner lamp shade and said rotatable outer lamp shade for removably and rotatably supporting said rotatable outer lamp shade on said stationary inner lamp shade, said bearing means comprising:

an upstanding pointed member located on said thrust plate at a location equidistant from said periphery, said upstanding pointed member having a pointed end facing directly away from said first end of said stationary inner lamp shade; and a bearing plate located at said second end of said rotatable outer lamp shade, said bearing plate having a centrally located bearing cone, said bearing cone having an apex facing away from said first end of said rotatable outer lamp shade, said bearing cone further being shaped so that said pointed end of said upstanding pointed member is caused to center in said apex of said bearing cone for bearingly supporting said rotatable outer lamp shade on said stationary inner lamp shade when said rotatable outer lamp shade receives said stationary inner lamp shade; and thrust means mounted at said second end of said rotatable outer lamp shade for directing said air convection current so that said rotatable outer lamp shade is caused to rotate on said bearing means, said thrust means comprising:

a plurality of air vent chutes annularly arranged between said bearing plate and said second end of said rotatable outer lamp shade for causing said air convection current to be directed in a substantially tangential direction with respect to said bearing means to thereby cause rotation of said rotatable outer lamp shade.

13. The multiple lamp shade system of claim 12, further comprising depictions on each of said stationary inner lamp shade and said rotatable outer lamp shade, said depictions visually interacting when said multiple lamp shade system is in operation.

14. The multiple lamp shade system of claim 13, wherein said thrust plate further has a conically shaped portion, said conically shaped portion having an apex located equidistant from said periphery and facing toward said first end of said stationary inner lamp shade.

15. The multiple lamp shade system of claim 14, wherein said thrust means further comprises flow means for ensuring said convection current is aerodynamically directed into said thrust means, said flow means comprising:

a frustoconically shaped member on said bearing plate, said frustoconically shaped member being located between said bearing cone and said plurality of air chute means.

16. The multiple lamp shade system of claim 15, further comprising an electrical circuit means connected with said socket for electrically connecting a source of electricity with said light bulb.

17. An illumination system, comprising:

a plurality of sockets electrically connected together to form an electrical circuit, each said socket having a multiple lamp shade system for a light bulb screwed into said socket, heat from said light bulb producing an air convection current, said multiple lamp shade system for each said socket comprising:

an apertured base adjacent said socket;

a light transmissible stationary inner lamp shade having a first end and a second end, said first end of said stationary inner lamp shade being removably attached to said apertured base;

exit means mounted at said second end of said stationary inner lamp shade for causing said air convection current having a first speed of movement when within said stationary inner lamp shade to exit said stationary inner lamp shade at a substantially increased speed of movement over said first speed of movement, said exit means comprising:

a thrust plate having a circular periphery; and a plurality of ribs connecting said thrust plate with said second end of said stationary inner lamp shade so that an annular gap is present between said circular periphery of said thrust plate and said second end of said stationary inner lamp shade;

a light transmissible rotatable outer lamp shade having a first end and a second end, said rotatable outer lamp shade removably and co-axially receiving said stationary inner lamp shade;

bearing means connected with said stationary inner lamp shade and said rotatable outer lamp shade for removably and rotatably supporting said rotatable outer lamp shade on said stationary inner lamp shade, said bearing means comprising:

an upstanding pointed member located on said thrust plate at a location equidistant from said periphery, said upstanding pointed member having a pointed end facing directly away from said first end of said stationary inner lamp shade; and a bearing plate located at said second end of said rotatable outer lamp shade, said bearing plate having centrally located bearing cone, said bearing cone having an apex facing away from said first end of said rotatable outer lamp shade, said bearing cone further being shaped so that said pointed end of said upstanding pointed member is caused to center in said apex of said bearing cone for bearingly supporting said rotatable outer lamp shade on said stationary inner lamp shade when said rotatable outer lamp shade receives said stationary inner lamp shade; and thrust means mounted at said second end of said rotatable outer lamp shade for directing said air convection current so that said rotatable outer lamp shade is caused to rotate on said bearing means, said thrust means comprising:

a plurality of air vent chutes annularly arranged between said bearing plate and said second end of said rotatable outer lamp shade for causing said air convection current to be directed in a substantially tangential direction with respect to said bearing means to thereby cause rotation of said rotatable outer lamp shade.

18. The multiple lamp shade system of claim 17, further comprising depictions on each of said stationary inner lamp shade and said rotatable outer lamp shade, said depictions visually interacting when said multiple lamp shade system is in operation.

19. The multiple lamp shade system of claim 18, wherein said thrust plate further has a conically shaped portion, said conically shaped portion having an apex located equidistant from said periphery and facing toward said first end of said stationary inner lamp shade.

20. The multiple lamp shade system of claim 19, wherein said thrust means further comprises flow means for ensuring said convection current is aerodynamically directed into said thrust means, said flow means comprising:

a frustoconically shaped member on said bearing plate, said frustoconically shaped member being located between said bearing cone and said plurality of air chute means;

said bearing cone further being shaped so that said pointed end of said upstanding pointed member is caused to center in said apex of said bearing cone for bearingly supporting said rotatable outer lamp shade on said stationary inner lamp shade.

* * * * *